US008662916B2

(12) United States Patent
Ashibu

(10) Patent No.: US 8,662,916 B2
(45) **Date of Patent: *Mar. 4, 2014**

(54) BOARD CONNECTOR

(75) Inventor: Kenta Ashibu, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 70 days.

This patent is subject to a terminal disclaimer.

(21) Appl. No.: 13/526,858

(22) Filed: Jun. 19, 2012

(65) Prior Publication Data

US 2013/0040477 A1 Feb. 14, 2013

(30) Foreign Application Priority Data

Aug. 10, 2011 (JP) ..... 2011-175090

(51) Int. Cl.
*H01R 12/24* (2006.01)

(52) U.S. Cl.
USPC ..... 439/495; 439/260

(58) Field of Classification Search
USPC ..... 449/260–264, 267, 492–495, 635, 372
See application file for complete search history.

(56) References Cited

U.S. PATENT DOCUMENTS

| | | | | |
|---|---|---|---|---|
| 3,858,957 | A * | 1/1975 | Harwood et al. | 439/59 |
| 6,431,897 | B1 * | 8/2002 | Hashiguchi et al. | 439/267 |
| 7,255,586 | B2 * | 8/2007 | Okada | 439/346 |
| 7,270,567 | B2 * | 9/2007 | Inoue | 439/495 |
| 7,422,472 | B2 * | 9/2008 | Hashiguchi et al. | 439/495 |
| 8,075,328 | B2 * | 12/2011 | Ashibu | 439/260 |
| 8,292,648 | B2 * | 10/2012 | Kiryu et al. | 439/328 |
| 8,298,001 | B2 * | 10/2012 | Ashibu et al. | 439/495 |
| 2007/0066127 | A1 | 3/2007 | Inoue | |
| 2008/0050958 | A1 | 2/2008 | Hashiguchi et al. | |
| 2008/0050966 | A1 | 2/2008 | Hashiguchi et al. | |
| 2011/0244709 | A1 | 10/2011 | Ashibu | |

FOREIGN PATENT DOCUMENTS

| | | | |
|---|---|---|---|
| JP | 2002-270292 | A | 9/2002 |
| JP | 2004-039479 | A | 2/2004 |
| JP | 2006-351288 | A | 12/2006 |
| JP | 2010-061927 | A | 3/2010 |
| JP | 2010-225448 | | 10/2010 |

OTHER PUBLICATIONS

English translation of relevant parts of Japanese Office Action dated Dec. 15, 2010 in Japanese Application No. 2010-235684.
English translation of relevant parts of Japanese Office Action dated Apr. 27, 2011 in Japanese Application No. 2010-235684.
Korean Office Action in Korean Application No. 2012-0076735, Jun. 26, 2013.

* cited by examiner

*Primary Examiner* — Neil Abrams
*Assistant Examiner* — Phuongchi T Nguyen
(74) *Attorney, Agent, or Firm* — Collard & Roe, P.C.

(57) ABSTRACT

A board connector comprising: a contact comprising a first and a second clipping portion and for clipping therebetween a board which is inserted from the outside, a first beam portion supporting the first clipping portion, and a second beam portion supporting the second clipping portion; a housing that supports the contact; an actuator that is fixed to the first beam portion; and a metal locking member that is fixed to the actuator, wherein the metal locking member has an action point portion that is formed at a position which is brought into physical contact with the board at the time of insertion of the board, and that is pushed by the board at the time of the insertion of the board.

10 Claims, 11 Drawing Sheets

BOARD CONNECTOR

This application is based upon and claims the benefit of priority from Japanese Patent Application No. 2011-175090, filed on Aug. 10, 2011, the disclosure of which is incorporated herein in its entirety by reference.

TECHNICAL FIELD

This invention relates to a connector and, in particular, relates to a board connector for connection between a plate-like connection object such as FPC (Flexible Printed Circuit) or FFC (Flexible Flat Cable) and another connection object.

BACKGROUND ART

As shown in FIG. 11, there is known an electrical connector 500 comprising contacts 530 each having a movable beam 531 and a stationary beam 532, an insulating housing 510 to which the stationary beams 532 are fixed, and an actuator 520 having a shaft member 525 which is rotatably supported by intermediate portions between the movable beams 531 and the stationary beams 532 of the contacts 530 (see, e.g. Patent Document 1:JP-A-2010-225448).

The actuator 520 has guide-locking portions 522 adapted to be pushed by a board T1 at the time of board insertion and an open-engaging portion 526 adapted to engage with front end portions of the movable beams 531. Each movable beam 531 has a terminal contact convex portion 531*a* adapted to serve as a contact point with the board T1.

This conventional electrical connector 500 is configured such that, at the time of board insertion, the guide-locking portions 522 of the actuator 520 are pushed to move upward by the board T1 and that, following this, the actuator 520 pivots on the shaft member 525 to cause the open-engaging portion 526 to engage and raise the movable beams 531.

SUMMARY OF THE INVENTION

However, the conventional electrical connector 500 has a problem that since the actuator 520 and the movable beams 531 that make different movements are linked together by the engagement between the open-engaging portion 526 and the movable beams 531, if a manufacturing or assembly error or the like occurs, the movements of the actuator 520 and the movable beams 531 are subjected to variation and, as a consequence, the accurate linking movements tend to be spoiled.

Further, the conventional electrical connector 500 has a problem that the pivotal support portions of the actuator 520 and the engaging portions between the actuator 520 and the movable beams 531 tend to be subjected to failure such as damage, deformation, or disengagement, thus leading to failure in the linkage mechanism.

If the accurate linkage between the actuator 520 and the movable beams 531 is degraded, there arises a problem that the distance between the movable beams 531 adapted to be raised by the insertion of the board T1 and the stationary beams 532 is subjected to variation, thereby impairing the contact reliability between the electrical connector 500 and the board T1 or damaging the board T1 due to sliding between the contacts 530 and the board T1.

Further, there is a problem that since the guide-locking portions 522 that are brought into physical contact with the board T1 at the time of board insertion and removal are formed of a resin, they tend to be damaged or deformed at the time of board insertion and removal.

This invention is intended to solve the above-mentioned conventional problems, that is, it is an object of this invention to provide a board connector that can prevent the occurrence of failure in linking function, that can achieve improvement in contact reliability and prevention of damage to a board, and that can prevent damage or deformation of an action point portion.

According to an exemplary aspect of the present invention, there is provided a board connector comprising: a contact comprising a first and a second clipping portion for clipping therebetween a board which is inserted from the outside, a first beam portion supporting the first clipping portion, and a second beam portion supporting the second clipping portion; a housing that supports the contact; an actuator that is fixed to the first beam portion; and a metal locking member that is fixed to the actuator, wherein the metal locking member has an action point portion (pressed portion) that is formed at a position which is brought into physical contact with the board at the time of insertion of the board, and that is pushed by the board at the time of the insertion of the board.

The metal locking member may have a locking portion for holding a fitted state of the board.

An angle between the locking portion and a board insertion direction for the board may be set so that, by pulling out the board toward a rear side in the board insertion direction in a state where the fitted state of the board is held by the locking portion, the actuator and the metal locking member are moved in a direction away from the housing to allow removal of the board.

The metal locking member may be integrally molded with the actuator.

The metal locking member may have a folded-back portion which is formed by folding back an end portion, on a rear side in the board insertion direction, of the metal locking member from the rear side toward a front side in the board insertion direction in a direction away from the second beam portion.

The metal locking member may have a ground contact portion adapted to be brought into contact with a mating ground contact portion of the board.

The metal locking member may have a terminal portion for connection to a second board that is fixed to the housing.

The contact may have a connecting portion that connects between the first beam portion and the second beam portion.

A plurality of contacts may be provided and are arranged in parallel with each other in a direction perpendicular to the board insertion direction.

The metal locking member may have a first beam portion that is fixed to the actuator, a second beam portion that is fixed to the housing, a connecting portion that connects between the first beam portion and the second beam portion, and a ground contact portion adapted to be brought into contact with a mating ground contact portion of the board, the first beam portion, the second beam portion, the connecting portion, and the ground contact portion being integral with each other.

EFFECT OF THE INVENTION

According to this invention, as a linkage mechanism for linking between the insertion of a board and an increase in distance between clipping portions of a contact, use is made of a simple structure in which a locking member having an action point portion adapted to be pushed by the board at the time of the insertion of the board, an actuator, and a first beam portion of the contact are fixed together. Accordingly, it is possible to suppress the occurrence of operation failure of a board connector due to failure of the linkage mechanism.

Since the locking member, the actuator, and the first beam portion of the contact are fixed together, it is possible to maintain accurate linkage between the locking member, the actuator, and the first beam portion. Accordingly, the distance between the clipping portions which increases by the insertion of the board can be maintained constant. Therefore, it is possible to avoid sliding between the board and the clipping portions to reliably prevent damage to the board and it is possible to improve the contact reliability between the board connector and the board.

Since the action point portion which is pushed by the board at the time of the insertion of the board is formed in the locking member made of a metal, it is possible to prevent damage to the action point portion at the time of the insertion of the board and thus to improve the product reliability of the board connector.

Since the action point portion is formed in the locking member, it is possible to improve the degree of freedom of design for the material, shape, and so on of the actuator.

EXEMPLARY EMBODIMENT

Hereinbelow, a board connector 100 according to an embodiment of this invention will be described with reference to the drawings.

Figure 1:
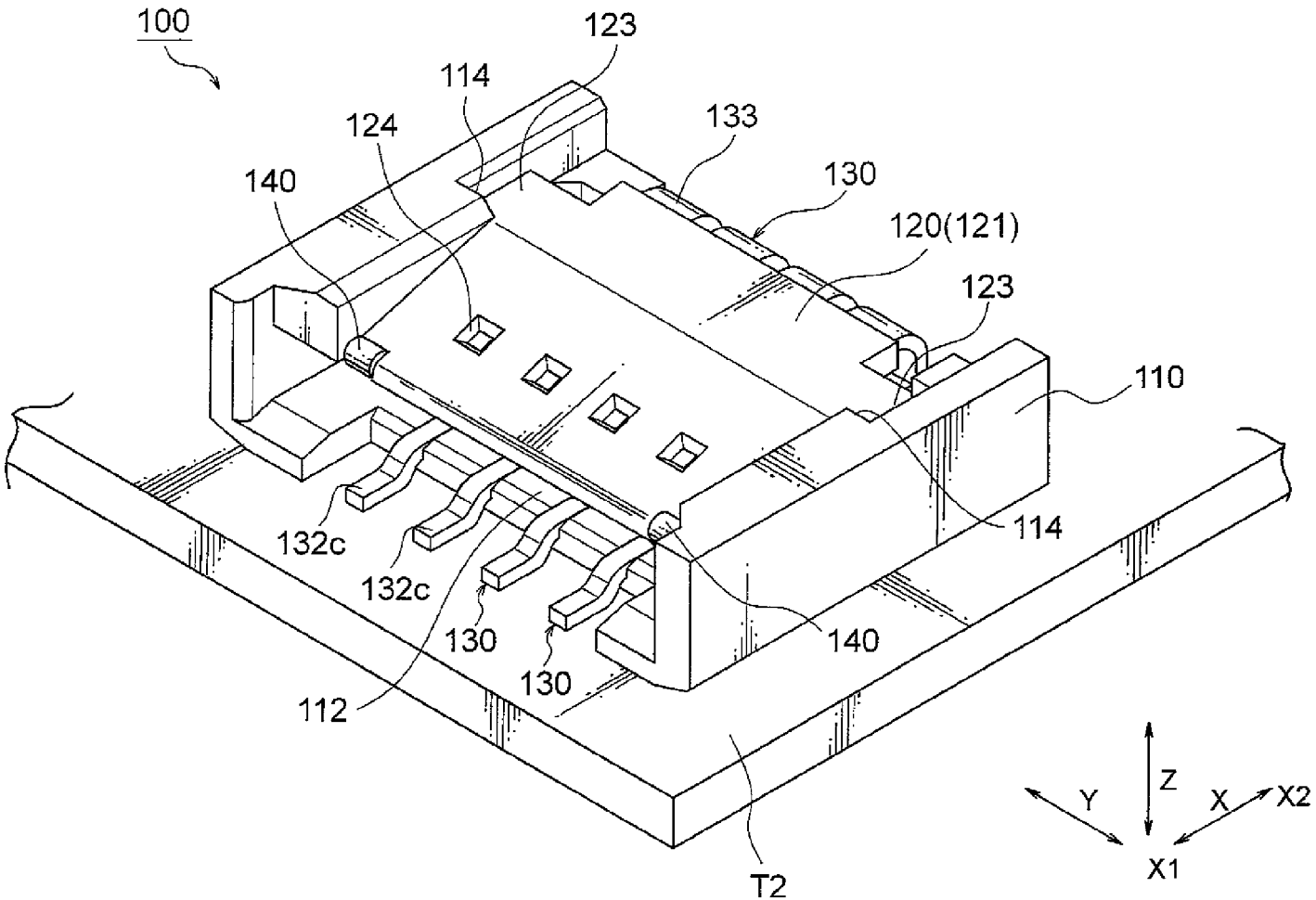
FIG. 1 is a perspective view showing a board connector according to an embodiment of this invention.
Figure 2:
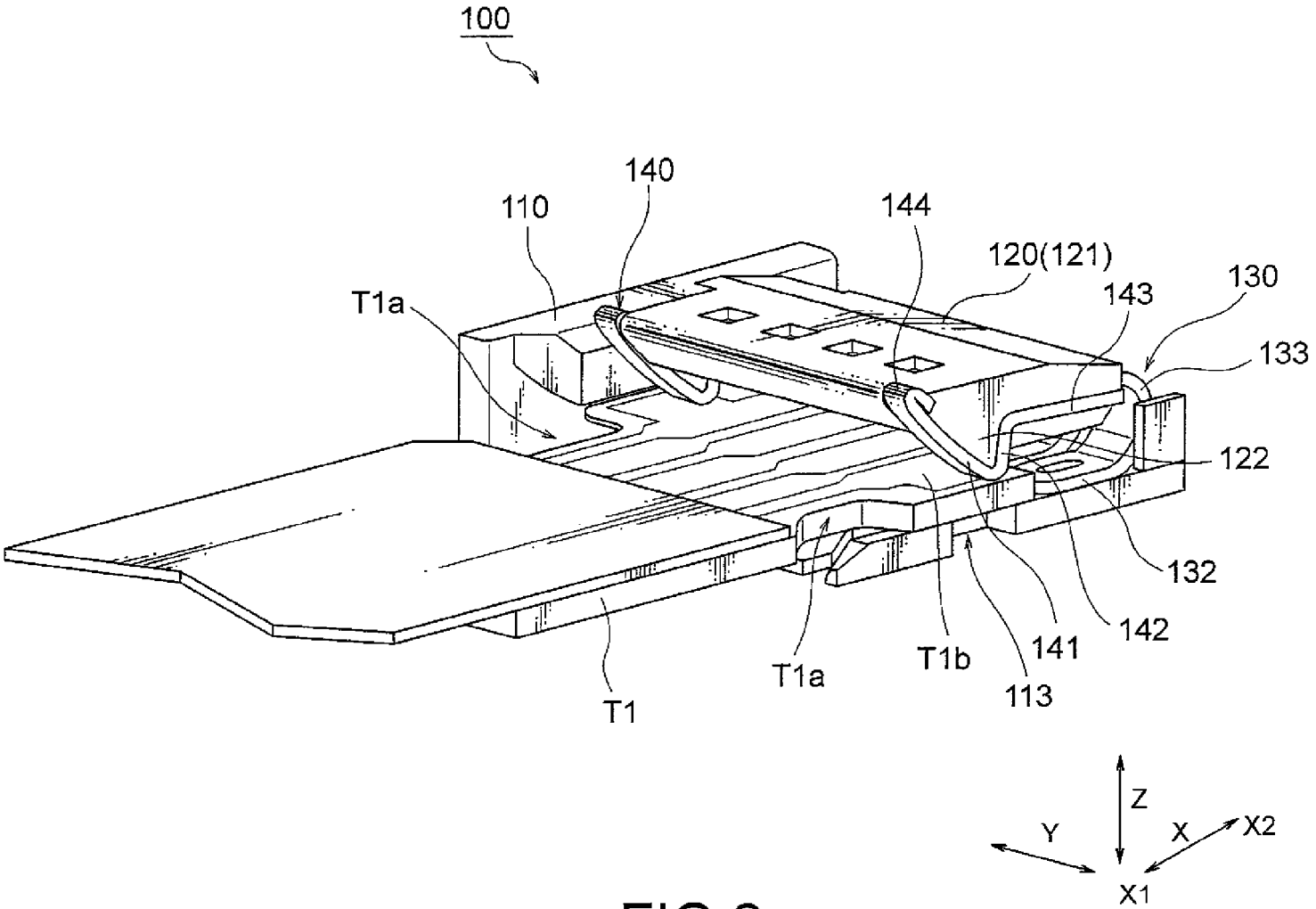
FIG. 2 is a perspective view, partly broken away, showing a state where a first board is on the way of insertion into or removal from the board connector.

As shown in FIGS. 1 and 2, the board connector 100 is used for connection between a first board (FPC, Flexible Printed Circuit) T1 adapted to be inserted into the board connector 100 from the outside and a second board (printed board) T2 mounting thereon the board connector 100.

Figure 6:
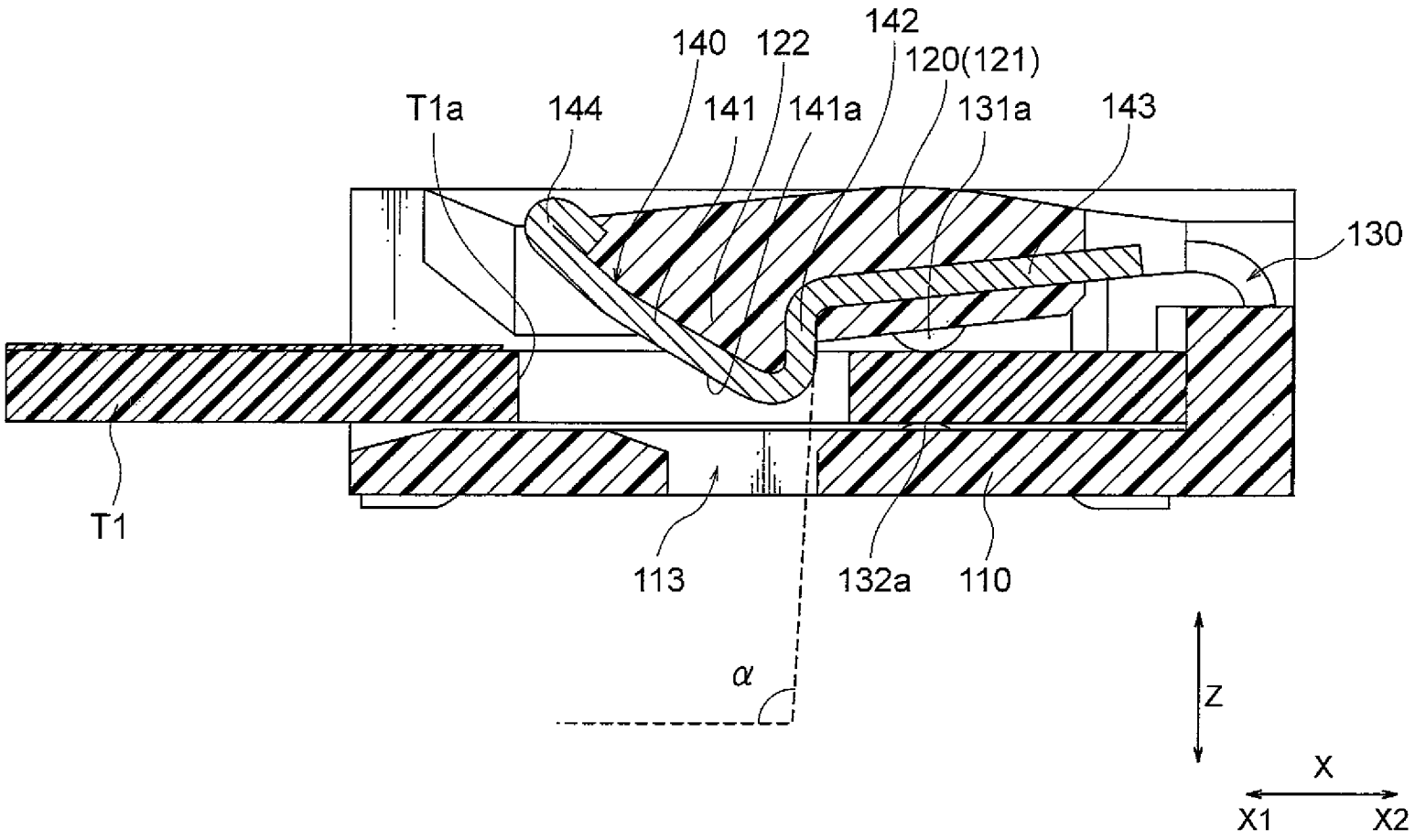
FIG. 6 is a cross-sectional view, taken in the vicinity of the locking member, of the board connector showing a state where the first board is inserted deepest into the board connector.

As shown in FIGS. 1 and 6, the board connector 100 comprises a housing 110, an actuator 120, a plurality of contacts 130, and a pair of locking members 140. The housing 110 and the actuator 120 are formed of an insulating resin, while the contacts 130 are formed of a copper alloy. The locking members 140 are formed of a metal with high strength.

Figure 7:
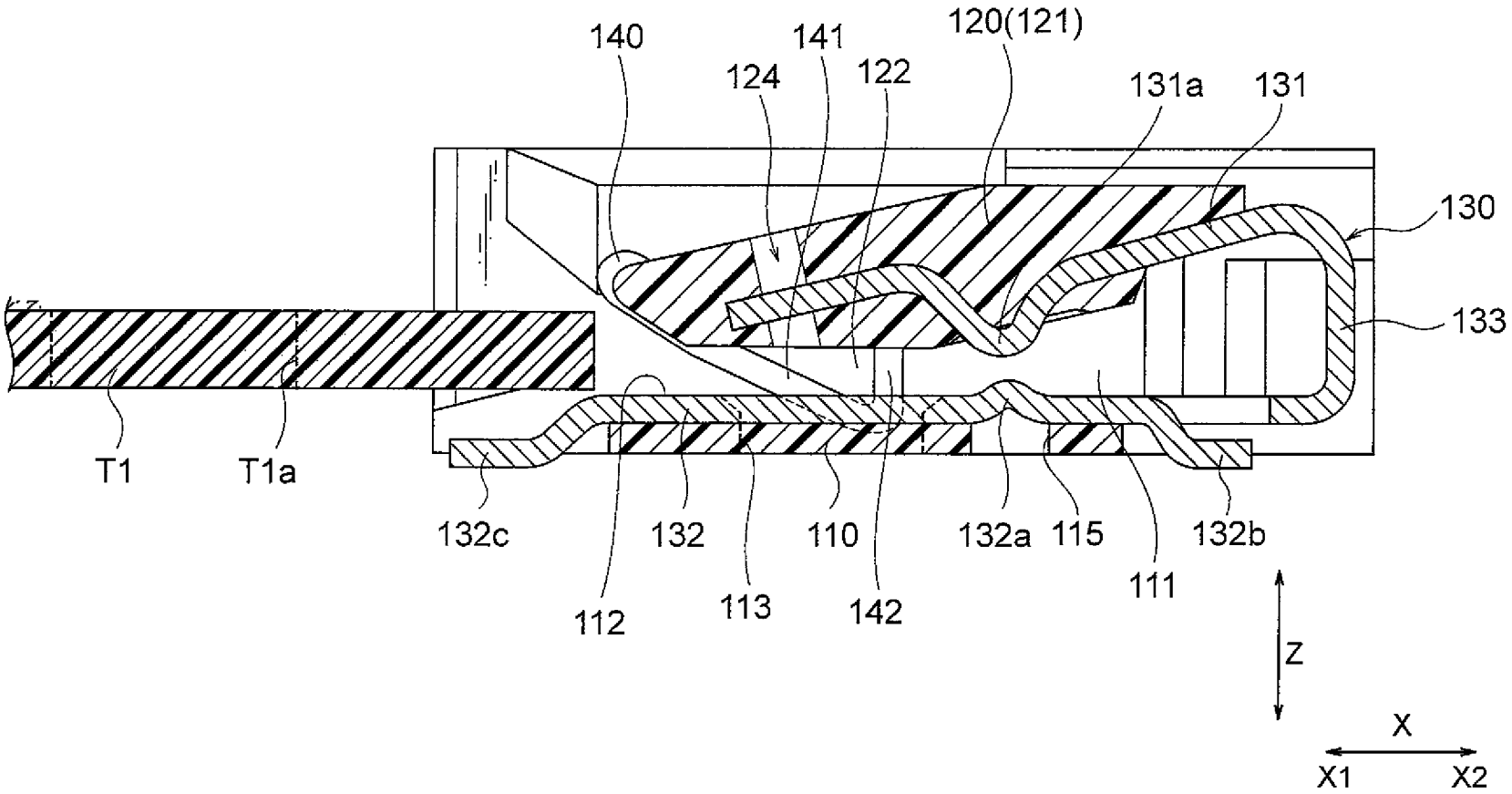
FIG. 7 is a cross-sectional view, taken in the vicinity of the contact, of the board connector showing a state where the first board is not inserted into the board connector.

As shown in FIG. 7, the housing 110 is integrally fixed to second beam portions 132 of the contacts 130 in the state where the second beam portions 132 are embedded in the housing 110.

As shown in FIGS. 1 and 7, the housing 110 has a board receiving portion 111, a board placing surface 112, a pair of action point portion receiving portions 113, a pair of movement regulating portions 114, and a plurality of housing hole portions 115.

Figure 8:
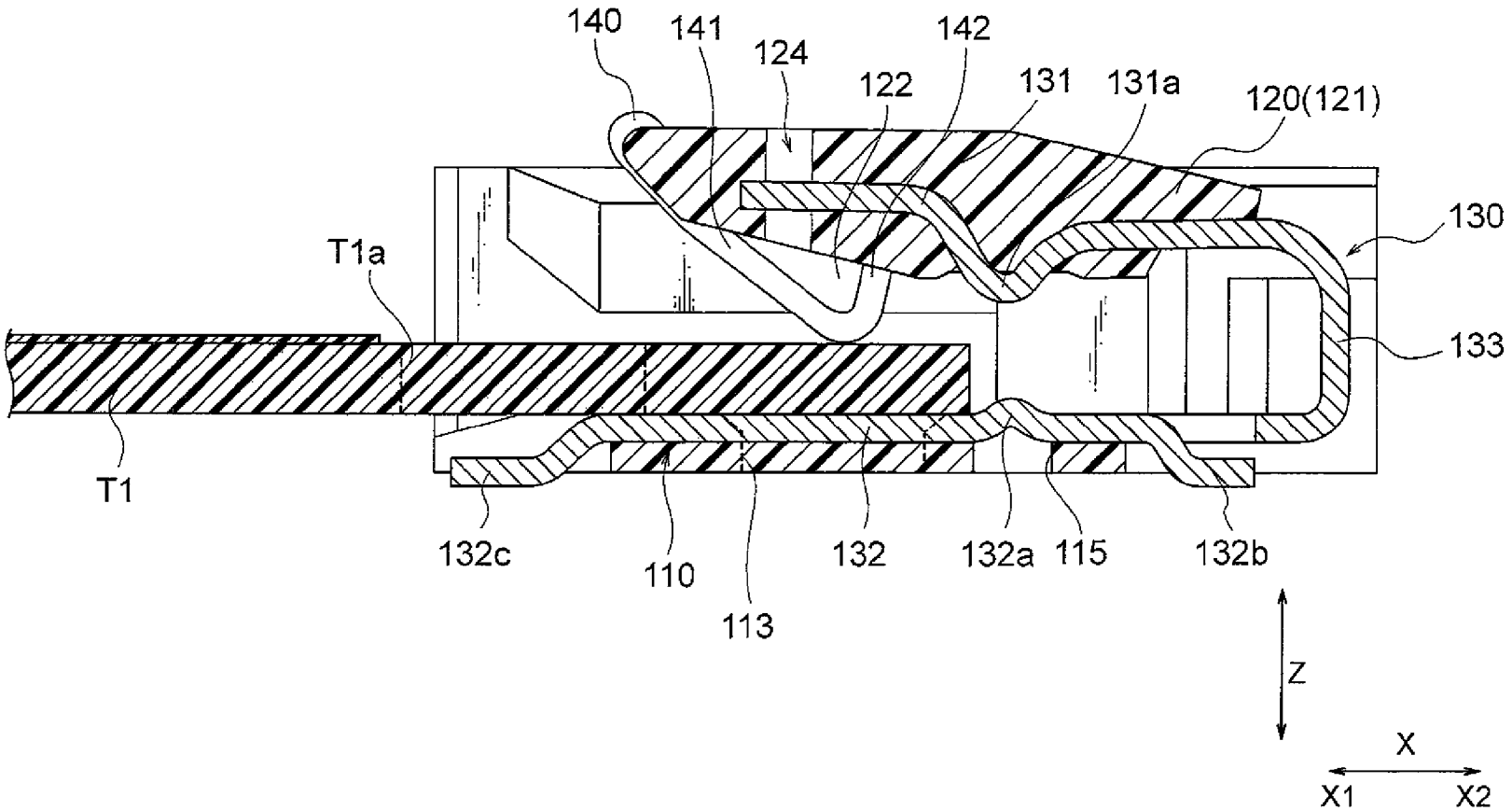
FIG. 8 is a cross-sectional view, taken in the vicinity of the contact, of the board connector showing a state where the first board is on the way of insertion into or removal from the board connector.

As shown in FIGS. 7 and 8, the board receiving portion 111 is a space formed jointly by the housing 110 and the actuator 120 and adapted to receive therein the first board T1 at the time of insertion of the first board T1 into the board connector 100.

As shown in FIGS. 7 and 8, the board placing surface 112 is an upper surface, facing the actuator 120 side, of a bottom plate of the housing 110 and serves as a placing surface for the first board T1 at the time of insertion of the first board T1 into the board connector 100.

Figure 3:
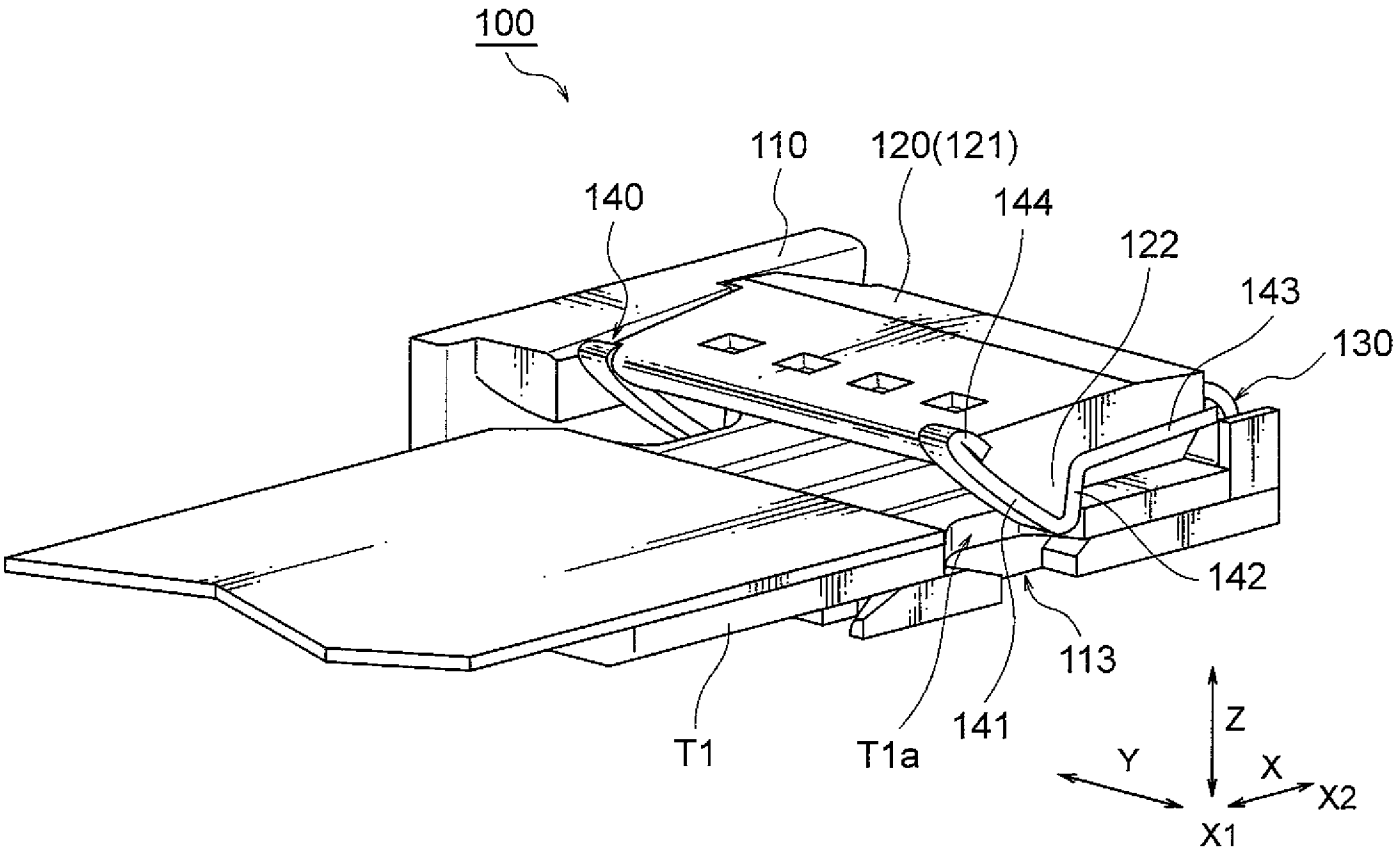
FIG. 3 is a perspective view, partly broken away, showing a state where the first board is inserted deepest into the board connector.

As shown in FIGS. 2 and 3, each action point portion receiving portion 113 is formed in the bottom plate of the housing 110 for receiving therein a part of an action point portion 141 of the locking member 140, a part of a locking portion 142 of the locking member 140, and a part of an action point portion integral portion 122 of the actuator 120.

As shown in FIGS. 1 to 4, the movement regulating portions 114 are formed in both side walls, in a contact arrangement direction Y perpendicular to a board insertion direction X, of the housing 110 and respectively faces protruding portions 123 of the actuator 120 from a rear side X1 in the board insertion direction X. When bending the contacts 130 in the manufacture of the board connector 100, the movement regulating portions 114 serve as marks for relative positioning between the actuator 120 and the housing 110 cooperatively with the protruding portions 123 of the actuator 120. Further, after the manufacture of the board connector 100, even if the first board T1 is caught by the actuator 120 and the locking members 140 when removing the first board T1 from the board connector 100, the movement regulating portions 114 engage with the protruding portions 123 of the actuator 120 to inhibit movement of the actuator 120 toward the rear side X1 in the board insertion direction X, thereby preventing deformation of the contacts 130 which is otherwise caused by the movement of the actuator 120.

Figure 4:
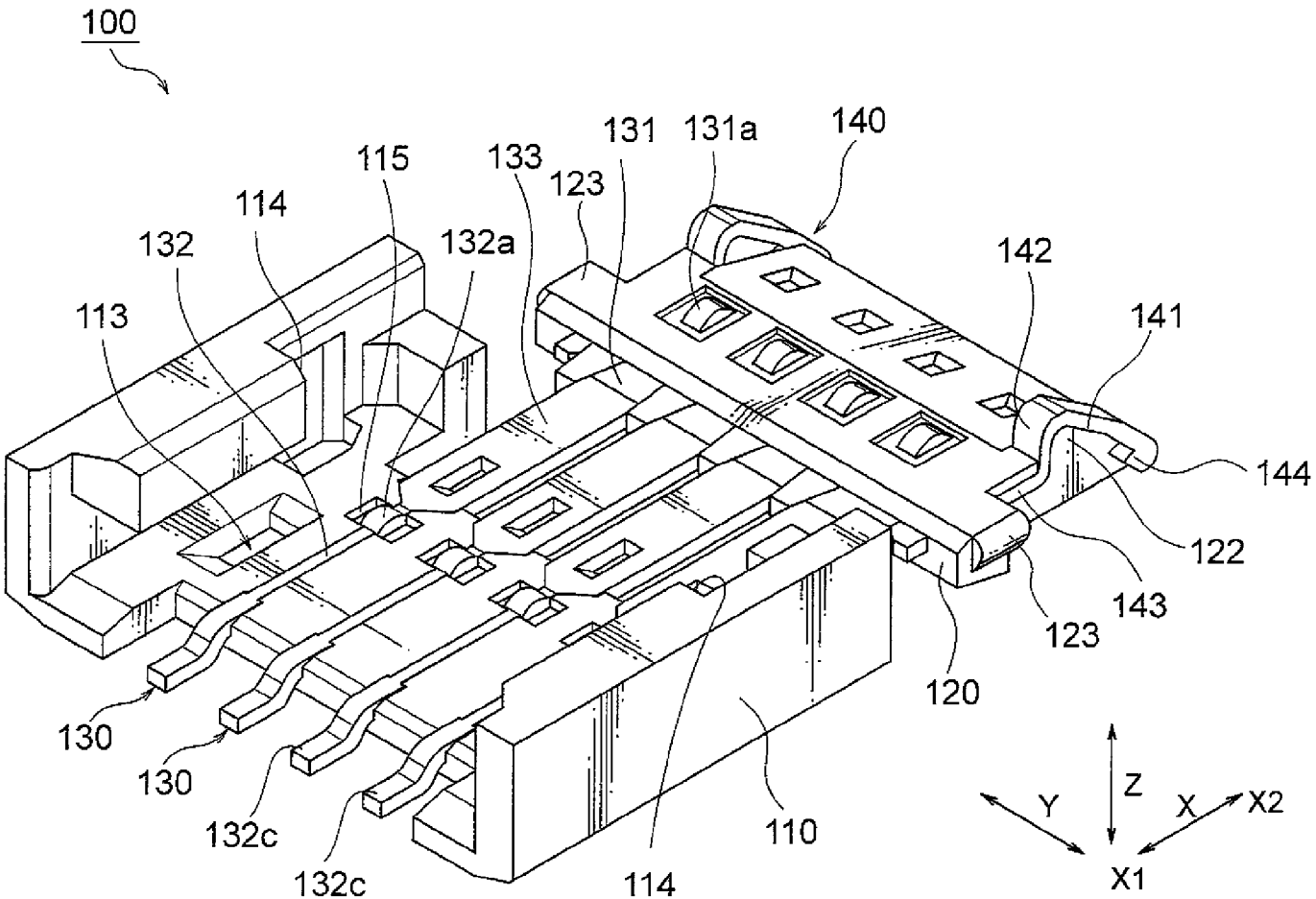
FIG. 4 is a perspective view showing a state on the way of manufacturing the board connector.

As shown in FIG. 4, the housing hole portions 115 are holes that are formed as a result of preventing movement of the second beam portions 132 using a mold when the housing 110 and the second beam portions 132 are integrally molded together.

As shown in FIGS. 1 to 4, the actuator 120 has a body portion 121, the pair of action point portion integral portions 122, the pair of protruding portions 123, and a plurality of actuator hole portions 124. As shown in FIGS. 4 and 7, the body portion 121 is integrally fixed to first beam portions 131 of the contacts 130 in the state where the first beam portions 131 are embedded in the body portion 121. The body portion 121 is not pivotally supported by the peripheral member/members such as the housing 110 or the contacts 130.

As shown in FIGS. 2 and 6, the action point portion integral portions 122 are respectively provided at two positions on both sides, in the contact arrangement direction Y, of the body portion 121 on the rear side X1, in the board insertion direction X, of the body portion 121. The action point portion integral portions 122 protrude from the body portion 121 toward the board placing surface 112 side. As will be described later, the locking members 140 are integrally fixed to the actuator 120, thereby reinforcing the action point portion integral portions 122 of the actuator 120.

As shown in FIG. 1, the protruding portions 123 protrude outward, in the contact arrangement direction Y, from both sides, in the contact arrangement direction Y, of the body portion 121 and respectively face the movement regulating portions 114 of the housing 110 from a front side X2 in the board insertion direction X. While the protruding portions 123 of the actuator 120 are used as portions whose movement toward the rear side X1 in the board insertion direction X is regulated by the movement regulating portions 114 of the housing 110, the specific configuration of such a portion is not limited thereto.

As shown in FIG. 1, the actuator hole portions 124 are holes that are formed as a result of preventing movement of the first beam portions 131 using a mold when the actuator 120 and the first beam portions 131 are integrally molded together.

As shown in FIG. 7, each contact 130 is of the normally closed type, i.e. the distance between a first clipping portion 131*a* and a second clipping portion 132*a* is set smaller than the thickness of the first board T1 in the state where the first board T1 is not inserted.

As shown in FIG. 7, each contact 130 has the first beam portion 131, the second beam portion 132, and a connecting portion 133 which are integral and continuous with each other.

As shown in FIGS. 4 and 7, the first beam portion 131 is for the most part embedded in the body portion 121 of the actuator 120 and is integrally fixed to the body portion 121.

As shown in FIGS. 6 and 7, the first beam portion 131 has the first clipping portion 131*a* exposed to the board receiving portion 111.

The first clipping portion 131*a* serves as a contact point with a corresponding one of pads T1*b* formed on a surface of the first board T1.

The first clipping portion 131*a* faces the second clipping portion 132*a*.

As described above, the first clipping portion 131*a* and the second clipping portion 132*a* face each other, i.e. the position of the first clipping portion 131*a* and the position of the second clipping portion 132*a* in the board insertion direction X coincide with each other. Alternatively, the position of the first clipping portion 131*a* and the position of the second clipping portion 132*a* in the board insertion direction X may be offset from each other.

As shown in FIGS. 4 and 7, the second beam portion 132 is for the most part embedded in the housing 110 and is integrally fixed to the housing 110.

As shown in FIG. 7, the second beam portion 132 has the second clipping portion 132*a* exposed to the board receiving portion 111, a first terminal portion 132*b* which is formed more on the front side X2 in the board insertion direction X than the second clipping portion 132*a* and is soldered to the second board T2, and a second terminal portion 132*c* which is formed more on the rear side X1 in the board insertion direction X than the second clipping portion 132*a* and is soldered to the second board T2.

As shown in FIG. 7, the connecting portion 133 connects between an end, on the front side X2 in the board insertion direction X, of the first beam portion 131 and an end, on the front side X2 in the board insertion direction X, of the second beam portion 132. The connecting portion 133 biases the first beam portion 131 and the second beam portion 132 so as to cause the first clipping portion 131*a* and the second clipping portion 132*a* to approach each other. In other words, the connecting portion 133 produces a clipping force between the first clipping portion 131*a* and the second clipping portion 132*a*. As shown in FIG. 7, the distance between the connecting portion 133 and the action point portion 141 of the locking member 140 is set longer than the distance between the connecting portion 133 and the first clipping portion 131*a*. This can reduce an insertion force required for the first board T1 to thereby improve the workability and can prevent excessive physical contact between the first board T1 and the action point portion 141 of the locking member 140 at the time of insertion of the first board T1 to thereby prevent damage to the first board T1. As shown in FIG. 1, the connecting portions 133 of the contacts 130 are arranged in parallel with each other in the contact arrangement direction Y in the state where the positions of the connecting portions 133 are aligned in the board insertion direction X and in a connector thickness direction Z, and accordingly, root portions of the first beam portions 131 (boundary portions between the first beam portions 131 and the connecting portions 133) each movable like a cantilever at the time of insertion of the first board T1 are also arranged in parallel with each other in the contact arrangement direction Y in the state where the positions of the root portions are aligned in the board insertion direction X and in the connector thickness direction Z. The connector thickness direction Z is perpendicular to the board insertion direction X and the contact arrangement direction Y.

As shown in FIG. 2, the locking members 140 are respectively disposed on both sides, in the contact arrangement direction Y, of the actuator 120 and are integrally fixed to the actuator 120. While the locking members 140 are integrally molded with the actuator 120 so as to be fixed to the actuator 120, the specific fixing configuration is not limited thereto. For example, the locking members 140 may be fixed to the actuator 120 by bonding or fitting.

As shown in FIGS. 2 and 6, each locking member 140 has the action point portion (front-side reinforcing portion) 141, the locking portion (rear-side reinforcing portion) 142, a fixed portion 143, and a folded-back portion 144 which are integral and continuous with each other.

The action point portion 141 is disposed on a surface of the action point portion integral portion 122 at a position which is brought into physical contact with and pushed by the first board T1 at the time of insertion of the first board T1 into the board connector 100. As shown in FIGS. 6 and 7, the action point portion 141 is disposed more on the rear side X1 in the board insertion direction X than the first and second clipping portions 131*a* and 132*a* of the contact 130. As shown in FIG. 6, the action point portion 141 has, on the rear side X1 in the board insertion direction X, an inclined surface 141*a* which is inclined so as to approach the board placing surface 112 toward the front side X2 in the board insertion direction X. By forming this inclined surface 141*a*, the locking member 140 along with the actuator 120 can be easily pushed upward with a small insertion force of the first board T1.

The locking portion 142 is disposed on a surface of the action point portion integral portion 122 at a position which is brought into physical contact with and pushed by the first board T1 at the time of removal of the first board T1 from the board connector 100. In a fitted state of the first board T1, the locking portion 142 engages with the first board T1 to hold the fitted state of the first board T1. As shown in FIGS. 6 and 7, the locking portion 142 is disposed more on the rear side X1 in the board insertion direction X than the first and second clipping portions 131*a* and 132*a* of the contact 130.

The fixed portion 143 is disposed more on the front side X2 in the board insertion direction X than the locking portion 142 and is fixedly embedded in the actuator 120.

The folded-back portion 144 is formed by folding back an end portion, on the rear side X1 in the board insertion direction X, of the locking member 140 from the rear side X1 to toward the front side X2 in the board insertion direction X in a direction away from the second beam portion 132 of the contact 130. An end of the folded-back portion 144 (an end, on the rear side X1 in the board insertion direction X, of the locking member 140) is disposed in the actuator 120 and thus is not exposed to the outside. With this configuration, it is possible to prevent damage to the hand of a worker, which is otherwise caused by the end of the locking member 140, without requiring a large processing load.

Since the locking portion 142 is formed in the locking member 140 made of the metal, while preventing damage to the locking portion 142 (and the action point portion integral portion 122), an angle α (see FIG. 6) between the locking portion 142 and the board insertion direction X can be set closer to an acute angle as compared with the case where the locking member 140 is not provided, in terms of the restrictions on the manufacture, and therefore, it is possible to improve the holding force by the locking portion 142 in the direction of removal of the first board T1 in the state where the first board T1 is inserted in the board connector 100. In order to allow the first board T1 to be removed when a worker strongly pulls it out while maintaining the locking force of the locking portion 142 which serves to prevent coming-off of the first board T1 due to impact or the like, the angle α is set to about 95 degrees. However, the angle α may be set to about 80 to 120 degrees according to a design.

The locking member 140 may have an electrical shielding function. A locking member 140' as a modification having this electrical shielding function will be described with reference to FIG. 10.

Figure 10:
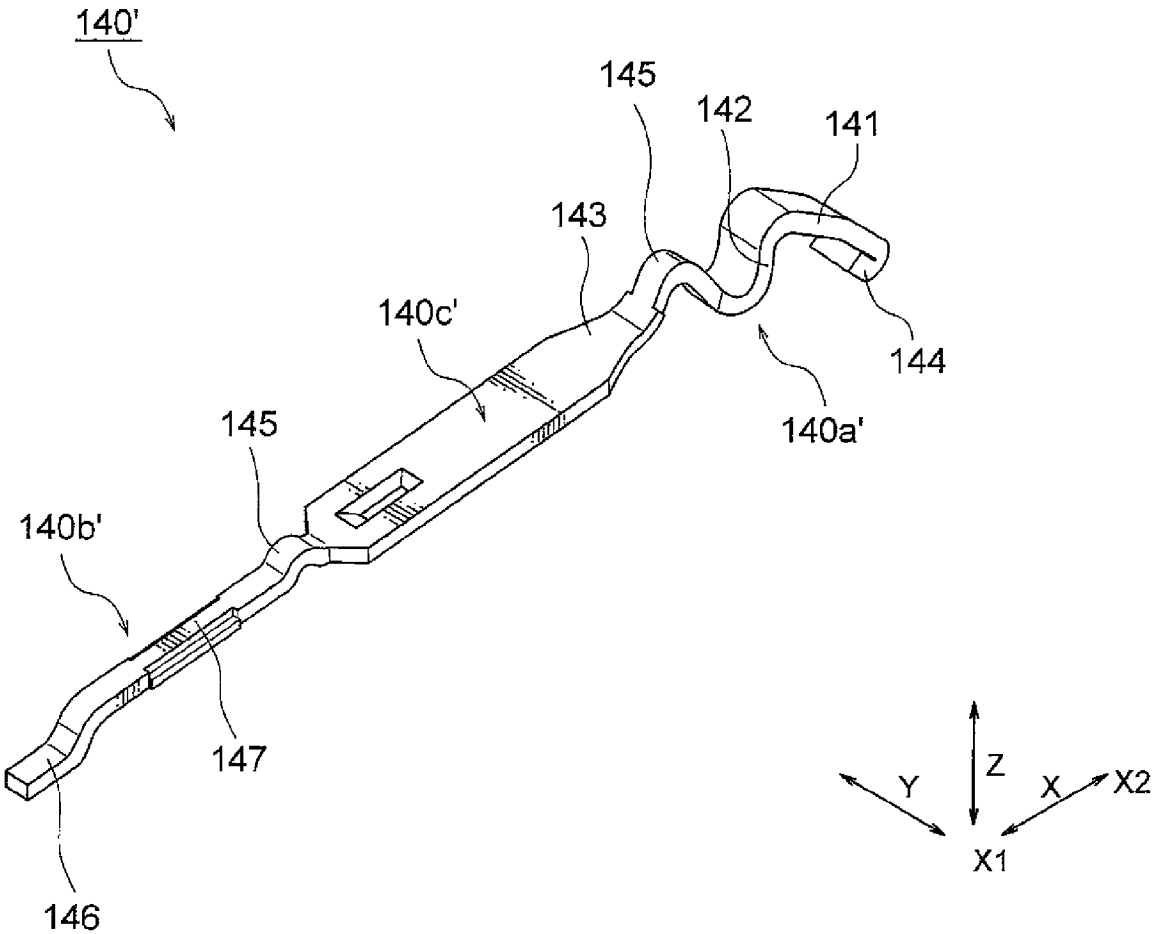
FIG. 10 is a perspective view showing a modification of the locking member.
Figure 11:
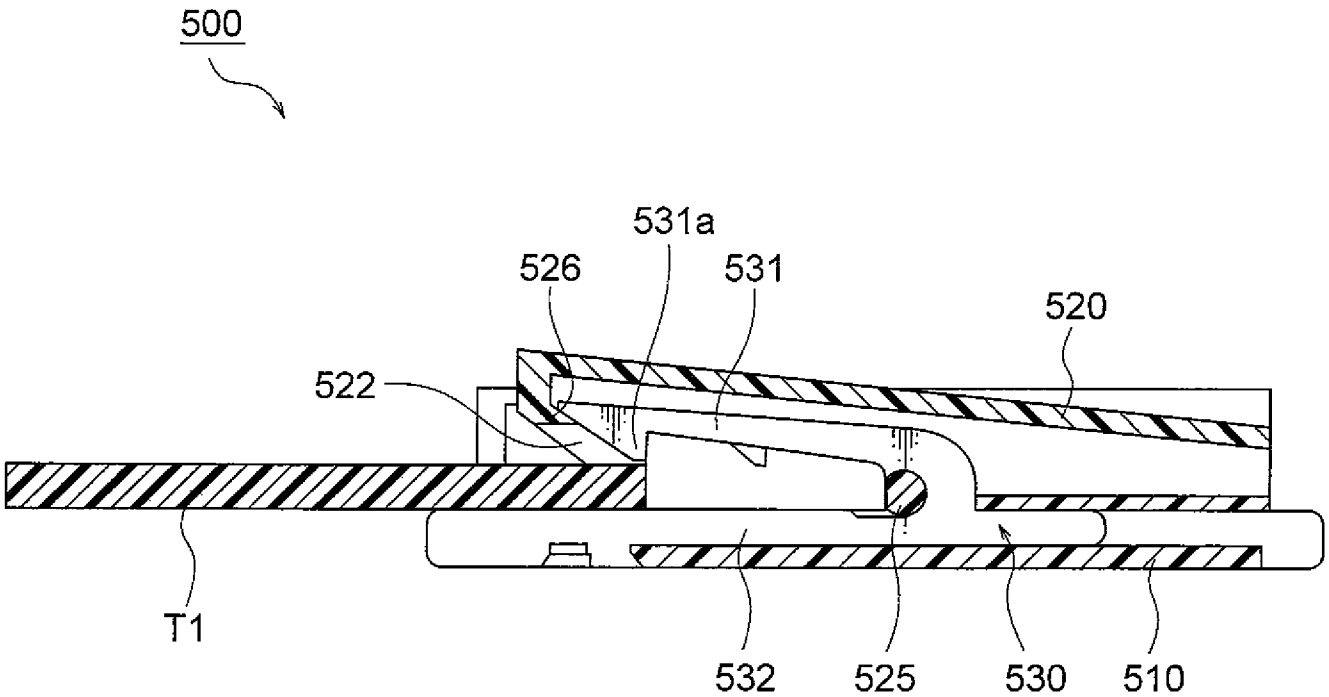
FIG. 11 is a cross-sectional view showing a conventional electrical connector.

As shown in FIG. 10, the locking member 140' has a first beam portion 140*a*' adapted to be integrally fixed to the actuator 120, a second beam portion 140*b*' adapted to be integrally fixed to the housing 110, a connecting portion 140*c*' connecting between the first and second beam portions 140*a*' and 140*b*', an action point portion 141, a locking portion 142, a to-be-fixed portion 143, a folded-back portion 144, a ground contact portion 145, and a terminal portion 146 adapted to be connected to the second board T2, which are integral and continuous with each other.

The first beam portion 140*a*', the second beam portion 140*b*', and the connecting portion 140*c*' of the locking member 140' are basically configured the same as the first beam portion 131, the second beam portion 132, and the connecting portion 133 of the contact 130, respectively.

The action point portion 141, the locking portion 142, the to-be-fixed portion 143, and the folded-back portion 144 formed in the first beam portion 140*a*' of the locking member 140' are configured the same as the action point portion 141, the locking portion 142, the fixed portion 143, and the folded-back portion 144 of the locking member 140, respectively.

The ground contact portion 145 is formed in the first beam portion 140*a*' and is adapted to be brought into contact with a mating ground contact portion (not illustrated) of the first board T1.

The terminal portion 146 is formed in the second beam portion 140*b*' and is adapted to be connected to the second board T2.

A to-be-fixed portion 147 is formed in the second beam portion 140*b*' and is adapted to be fixed to the housing 110.

The locking member 140' shown in FIG. 10 is in a state on the way of manufacturing the board connector 100. In the manufacture of the board connector 100, the to-be-fixed portion 143 is fixed to the actuator 120 and the to-be-fixed portion 147 is fixed to the housing 110, and thereafter, the locking member 140' is bent like the contact 130. The handling of the locking member 140' in the manufacture of the board connector 100 is the same as that of the contact 130, which will be described later, and therefore, detailed explanation thereof is omitted.

As shown in FIG. 2, the first board T1 has action point portion receiving portions T1*a* which are respectively formed at two positions on both sides, in the contact arrangement direction Y, of the first board T1 and each of which is adapted to receive therein a part of the action point portion 141 of the locking member 140, a part of the locking portion 142 of the locking member 140, and a part of the action point portion integral portion 122 of the actuator 120, and further has the pads T1*b* adapted to be connected to the first clipping portions 131*a* of the contacts 130, respectively.

While the pads T1*b* and conductor patterns are formed only on the surface, facing the first clipping portions 131*a*, of the first board T1, pads and conductor patterns may be formed also on the back surface side of the first board T1. In this case, the second clipping portions 132*a* are also used as contact points with the first board T1.

A hold-down (not illustrated) of the board connector 100 may be soldered to the second board T2.

With this hold-down, the housing 110 and the second board T2 are fixed together more firmly.

Hereinbelow, a method of manufacturing the board connector 100 will be described.

Figure 5:
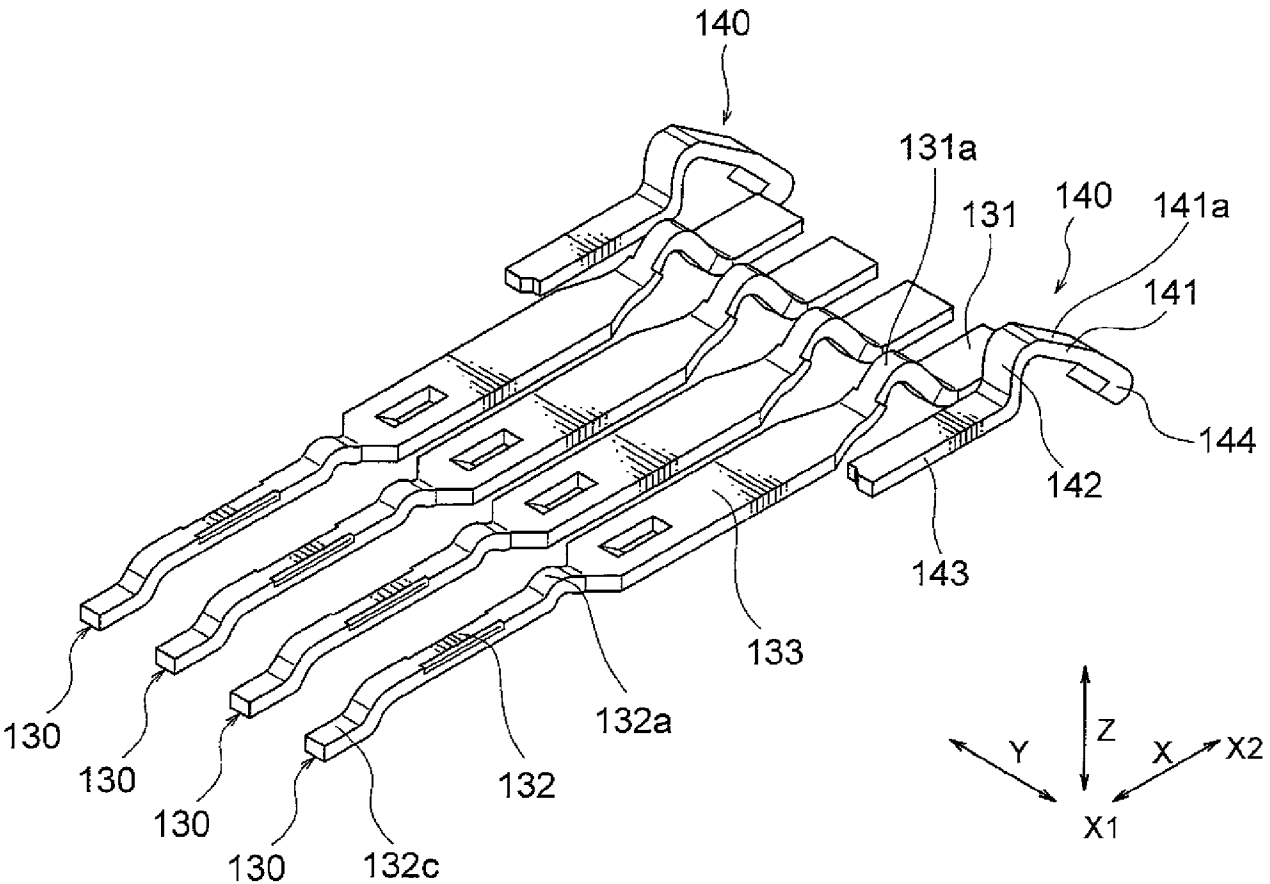
FIG. 5 is a perspective view showing contacts and locking members.

First, as shown in FIG. 5, the contacts 130 with the connecting portions 133 not being bent and the locking members 140 are prepared and arranged in parallel with each other.

Then, in the state where the contacts 130 and the locking members 140 are placed in a mold, the actuator 120 and the housing 110 are insert-molded, so that the actuator 120, the first beam portions 131 of the contacts 130, and the locking members 140 are integrally molded together and that the housing 110 and the second beam portions 132 of the contacts 130 are integrally molded together. When molding the actuator 120 and the housing 110, it is necessary to prevent movement of the first beam portions 131 and, as a result, the actuator hole portions 124 are formed in the actuator 120 as shown in FIG. 1, while it is necessary to prevent movement of the second beam portions 132 and, as a result, the housing hole portions 115 are formed in the housing 110 as shown in FIG. 4.

Then, finally, the contacts 130 are bent at the connecting portions 133, respectively.

In this event, the movement regulating portions 114 of the housing 110 and the protruding portions 123 of the actuator 120 serve as marks for relative positioning between the actuator 120 and the housing 110 and the contacts 130 are bent so that the protruding portions 123 are located on the front side X2 in the board insertion direction X of the movement regulating portions 114. This makes it possible to achieve accurate bending of the contacts 130. Further, the action point portions 141 and the locking portions 142 of the locking members 140 integral with the actuator 120 and the action point portion receiving portions 113 of the housing 110 also serve as marks at the time of bending the contacts 130.

Hereinbelow, a method of attaching the first board T1 to the board connector 100 and the operations of the respective components at the time of attaching the first board T1 will be described with reference to FIGS. 6 to 9.

First, as shown in FIGS. 6 to 8, a worker inserts the first board T1 between the housing 110 and the actuator 120 from the rear side X1 toward the front side X2 in the board insertion direction X.

In this event, since the action point portions 141 of the locking members 140 each have the inclined surface 141*a* which is inclined so as to approach the board placing surface 112 toward the front side X2 in the board insertion direction X, the actuator 120 is pushed upward in a direction away from the board placing surface 112 through the locking members 140 by the insertion of the first board T1 as shown in FIG. 8.

In this event, as shown in FIG. 8, the first beam portions 131 integral with the actuator 120 are pushed upward along with the actuator 120 in the direction away from the board placing surface 112. In this event, the connecting portions 133 are elastically deformed, so that the first beam portions 131 are each moved like a cantilever.

As a result, as shown in FIG. 8, the distance between the first and second clipping portions 131*a* and 132*a* is increased so as to be greater than the thickness of the first board T1.

Then, the first board T1 further pushed toward the front side X2 in the board insertion direction X by the worker enters between the first and second clipping portions 131*a* and 132*a*.

Figure 9:
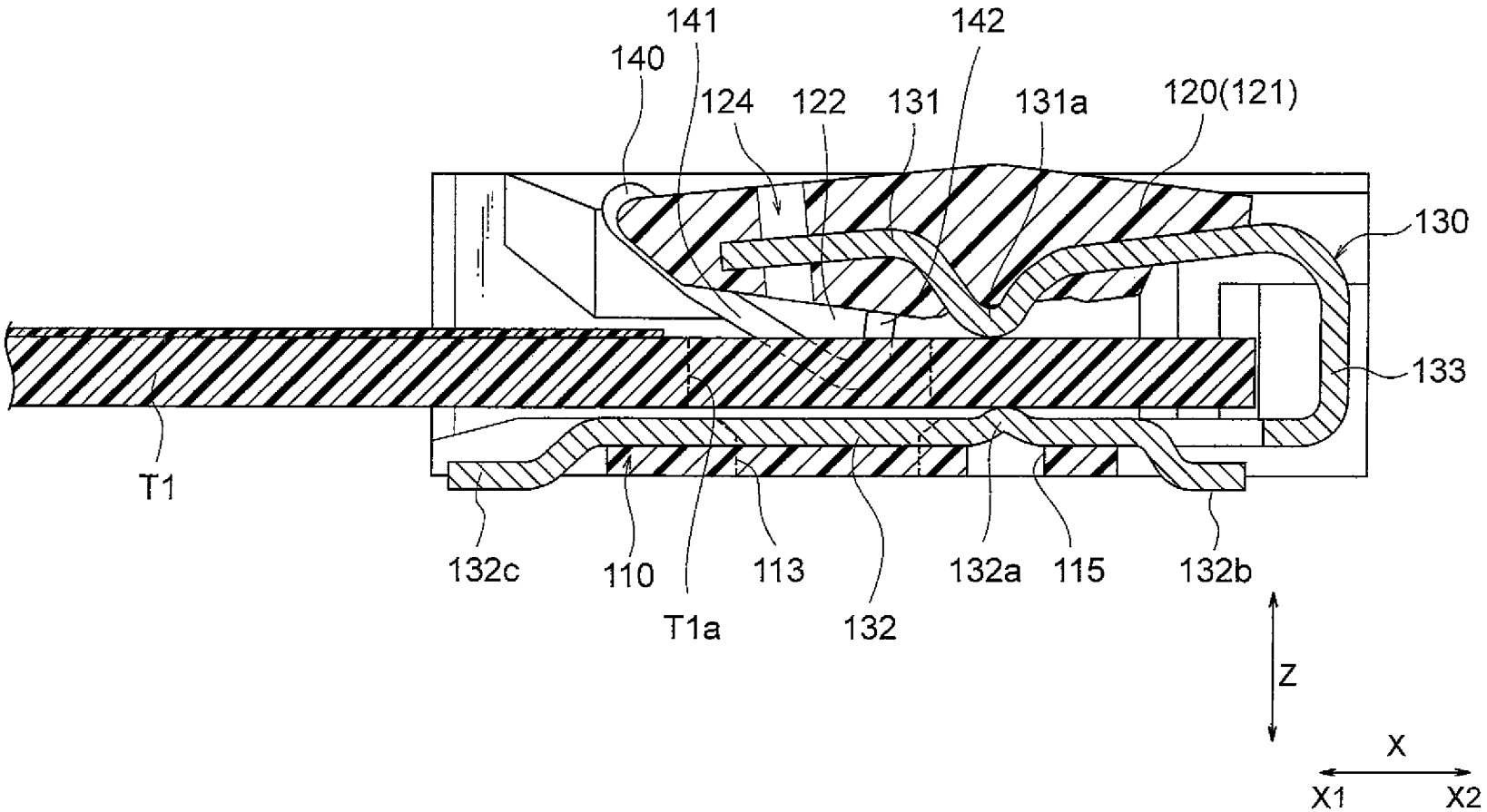
FIG. 9 is a cross-sectional view, taken in the vicinity of the contact, of the board connector showing a state where the first board is inserted deepest into the board connector.

Then, the first board T1 is further pushed toward the front side X2 in the board insertion direction X by the worker and, as shown in FIG. 9, the position of each action point portion receiving portion T1*a* of the first board T1 coincides with the positions of the action point portion 141 and the locking portion 142 of the locking member 140 and of the action point portion integral portion 122 of the actuator 120.

In this event, since the action point portions 141 and the locking portions 142 of the locking members 140 and the action point portion integral portions 122 of the actuator 120 lose the support by the first board T1, the connecting portions 133 are elastically restored to cause the actuator 120 to move in a direction toward the board placing surface 112 side.

As a result, as shown in FIG. 9, the distance between the first and second clipping portions 131*a* and 132*a* of each contact 130 attempts to return to the normal distance, i.e. attempts to be smaller than the thickness of the first board T1.

Accordingly, the first and second clipping portions 131*a* and 132*a* of the contacts 130 clip the first board T1 therebetween, so that connection between the first clipping portions 131*a* and the pads T1*b* of the first board T1 is established.

Simultaneously, a part of the action point portion 141 of the locking member 140, a part of the locking portion 142 of the locking member 140, and a part of the action point portion integral portion 122 of the actuator 120 are received in each action point portion receiving portion T1*a* of the first board T1.

As a consequence, the first board T1 is positioned with respect to the board connector 100 and is prevented from coming off the board connector 100.

Hereinbelow, a method of detaching the first board T1 from the board connector 100 will be described with reference to FIGS. 6 to 9.

Removal of the first board T1 from the board connector 100 is achieved by a single operation of pulling out the first board T1 from the board connector 100 toward the rear side X1 in the board insertion direction X. The operations of the respective components of the board connector 100 at the time of the removal of the first board T1 are as follows.

When the worker starts to strongly pull out the first board T1 from the board connector 100 toward the rear side X1 in the board insertion direction X, first, edge portions of the action point portion receiving portions T1*a* of the first board T1 push the action point portion integral portions 122 of the actuator 120 through the locking portions 142 of the locking members 140, so that the actuator 120 is pushed upward in the direction away from the board placing surface 112.

In this event, as shown in FIG. 8, the first beam portions 131 integral with the actuator 120 are pushed upward along with the actuator 120 in the direction away from the board placing surface 112. In this event, the connecting portions 133 are elastically deformed, so that the first beam portions 131 are each moved like a cantilever.

As a result, the distance between the first and second clipping portions 131*a* and 132*a* is increased so as to be greater than the thickness of the first board T1. Accordingly, the worker can easily pull out the first board T1 from between the first and second clipping portions 131*a* and 132*a*.

Even if the first board T1 engages with (is caught by) the locking members 140 at the time of pulling out the first board T1, the protruding portions 123 engage with the movement regulating portions 114 to prevent the actuator 120 from moving toward the rear side X1 in the board insertion direction X along with the first board T1 and therefore it is possible to prevent deformation of the contacts 130 which is otherwise caused by the movement of the actuator 120.

Since the board connector 100 thus obtained is configured to increase the distance between the first and second clipping portions 131*a* and 132*a* of the contacts 130 using the first board T1 inserted into the board connector 100, the operation of the actuator 120 is not required apart from the insertion operation of the first board T1. Therefore, it is possible to achieve the attaching operation of the first board T1 by the single operation of inserting the first board T1 and thus to extremely reduce the operation load for the attaching operation of the first board T1.

Further, since the distance between the first and second clipping portions 131*a* and 132*a* is automatically increased by a certain required amount by the insertion of the first board T1, even if the first board T1 is manufactured to be thicker in a tolerance range, it is possible to avoid excessive sliding between the first board T1 and the first and second clipping portions 131*a* and 132*a*, thereby preventing damage to the first board T1.

Further, since the board connector 100 is configured to move the actuator 120 by the insertion of the first board T1 without manually operating the actuator 120, the moving amount of the actuator 120 at the time of the insertion of the first board T1 is limited to a degree that allows the first board T1 to be inserted between the first and second clipping portions 131*a* and 132*a* and an excessive force as in a case of manual operation of the actuator 120 is prevented from being applied to the actuator 120 and so on, so that it is possible to prevent damage to the actuator 120 and so on.

Further, since manual operation of the actuator 120 is not required, even if the entire board connector 100 is designed to be small, it is possible to avoid a situation where it is difficult to manually operate the actuator 120 with fingers of a normal worker, so that the attaching operation of the first board T1 can be easily achieved.

Further, since the locking members 140, the actuator 120, and the first beam portions 131 are integrally fixed together, the movement of the locking members 140, the movement of the actuator 120, and the movement of the first beam portions 131 at the time of the insertion of the first board T1 can be completely integral with each other, so that it is possible to avoid sliding between the actuator 120 and the first beam portions 131 at the time of the insertion of the first board T1, thus to prevent the generation of abrasion powder due to the sliding to thereby avoid adhesion of abrasion powder to the contacts 130 and the first board T1, and thus to ensure the contact reliability of the board connector 100.

Further, since the action point portion 141 and the locking portion 142 which are pushed by the first board T1 at the time of inserting and removing the first board T1 are formed in the locking member 140 made of the metal, it is possible to prevent damage to the action point portion 141 and the locking portion 142 at the time of inserting and removing the first board T1 and thus to improve the product reliability of the board connector 100.

Further, since the locking portion 142 is formed in the locking member 140 made of the metal, by strongly pulling out the first board T1 toward the rear side X1 in the board insertion direction X to raise the actuator 120 at the time of removing the first board T1, it is possible to release locking of the first board T1 by the locking member 140 without damaging the actuator 120, so that it is possible to achieve the removal of the first board T1 by the single operation of pulling out the first board T1.

Further, since the locking portion 142 is formed in the locking member 140 made of the metal, while preventing damage to the actuator 120, the angle α between the locking portion 142, which is brought into physical contact with the first board T1 at the time of removing the first board T1, and the board insertion direction X can be set closer to an acute angle as compared with the case where the locking member 140 is not provided, and therefore, it is possible to improve the holding force for the first board T1 without causing damage to the actuator 120.

Further, since the action point portion 141 and the locking portion 142 are formed in the locking member 140 made of the metal, it is possible to improve the degree of freedom of design for the material, shape, and so on of the actuator 120.

The locking members 140, the actuator 120, and the contacts 130 are integrally molded together, while the housing 110 and the contacts 130 are integrally molded together.

Accordingly, the operation of attaching the contacts 130 to the actuator 120 and the housing 110 is not required and the locking members 140, the contacts 130, the actuator 120, and the housing 110 can be handled as a single member, so that the manufacturing load can be reduced. Further, since it is possible to avoid disengagement between the locking members 140, the actuator 120, and the contacts 130 and disengagement between the housing 110 and the contacts 130, the product reliability can be improved.

The clipping force between the first and second clipping portions 131*a* and 132*a* is produced by the connecting portion 133 which is formed by bending a metal material.

Accordingly, not only the structure of the contact 130 is simplified, but also the board connector 100 can be manufactured only by bending the contacts 130 after the actuator 120 and the housing 110 are integrally molded with the contacts 130, so that the manufacturing load of the board connector 100 can be extremely reduced.

As a linkage mechanism for linking between the pushed movement of the locking members 140 due to the insertion of the first board T1 and the increase in distance between the first and second clipping portions 131*a* and 132*a*, use is made of the simple structure in which the locking members 140 each having the action point portion 141 adapted to be pushed by the first board T1, the actuator 120, and the first beam portions 131 of the contacts 130 are integrated together. Accordingly, it is possible to suppress the occurrence of operation failure of the board connector 100 due to failure of the linkage mechanism.

Since the locking members 140, the actuator 120, and the first beam portions 131 of the contacts 130 are integrally fixed together, it is possible to maintain accurate linkage between the locking members 140, the actuator 120, and the first beam portions 131. Accordingly, the distance between the first and second clipping portions 131*a* and 132*a* which increases by the insertion of the first board T1 can be maintained constant and thus it is possible to avoid sliding between the first board T1 and the first and second clipping portions 131*a* and 132*a*, so that damage to the first board T1 can be reliably prevented.

The housing 110 and the first board T1 respectively have the action point portion receiving portions 113 and T1*a* for receiving therein the locking member 140.

Accordingly, the thickness of the entire board connector 100 can be reduced and, since the first board T1 is positioned with respect to the board connector 100 and is prevented from coming off the board connector 100, it is possible to reliably maintain connection between the pads T1*b* of the first board T1 and the first clipping portions 131*a* of the contacts 130.

Since the connecting portion 133 biases the first and second beam portions 131 and 132 so as to cause the first and second clipping portions 131*a* and 132*a* to approach each other, it is possible to prevent the actuator 120 from unexpectedly moving to rise with respect to the housing 110 before or after attaching the first board T1.

In the above-mentioned embodiment, the description has been given assuming that the first board is FPC (Flexible Printed Circuit). However, it may be any plate-like connection object such as FFC (Flexible Flat Cable).

In the above-mentioned embodiment, the description has been given assuming that the first clipping portion of each contact serves as a contact point with the first board. However, the second clipping portion may alternatively be used as a contact point with the first board or both the first and second clipping portions may be used as contact points with the first board. Further, apart from the first and second clipping portions, a contact point with the first board may be formed in at least one of the first and second beam portions.

In the above-mentioned embodiment, the description has been given assuming that the actuator is not pivotally supported by the peripheral member/members such as the housing or the contacts. However, the actuator may be pivotally supported by the peripheral member/members such as the housing or the contacts. In this case, in order to ensure smooth movability of the actuator, the positions of root portions of the first beam portions each movable like a cantilever at the time of insertion of the first board and the position of a pivot axis of the actuator are adjusted with each other so that, specifically, those positions coincide with each other or are close to each other in the board insertion direction X and in the connector thickness direction Z.

In the above-mentioned embodiment, all the contacts have the same shape. However, a plurality of contacts having different shapes may be combined and used. In this case, in order to ensure smooth movability of the actuator even when the actuator and first beam portions of the contacts are integrally fixed together, the contacts are arranged in parallel with each other in the contact arrangement direction Y in the state where the positions of root portions of the first beam portions (near boundaries between the first beam portions and connecting portions) each movable like a cantilever at the time of insertion of the first board coincide with each other or are close to each other in the board insertion direction X and in the connector thickness direction Z.

In the above-mentioned embodiment, the actuator and the first beam portions are integrally fixed together by integrally molding the actuator and the first beam portions together. However, the specific fixing configuration is not limited thereto. For example, the actuator and the first beam portions may be integrally fixed together by bonding the actuator and the first beam portions together or fitting (e.g. press-fitting) the actuator and the first beam portions together.

In the above-mentioned embodiment, the housing and the second beam portions are integrally fixed together by integrally molding the housing and the second beam portions together. However, the specific fixing configuration is not limited thereto. For example, the housing and the second beam portions may be integrally fixed together by bonding the housing and the second beam portions together or fitting (e.g. press-fitting) the housing and the second beam portions together.

What is claimed is:

1. A board connector comprising:

a contact comprising a first and a second clipping portion for clipping therebetween a board which is inserted from the outside, a first beam portion supporting the first clipping portion, and a second beam portion supporting the second clipping portion;

a housing that supports the contact;

an actuator that is fixed to the first beam portion; and a metal locking member that is fixed to the actuator, wherein the metal locking member has an action point portion that is formed at a position which is brought into physical contact with the board at the time of insertion of the board, and that is pushed by the board at the time of the insertion of the board.

2. The board connector according to claim 1, wherein the metal locking member is integrally molded with the actuator.

3. The board connector according to claim 1, wherein the metal locking member has a folded-back portion which is formed by folding back an end portion, on a rear side in the board insertion direction, of the metal locking member from the rear side toward a front side in the board insertion direction in a direction away from the second beam portion.

4. The board connector according to claim 1, wherein the metal locking member has a ground contact portion adapted to be brought into contact with a mating ground contact portion of the board.

5. The board connector according to claim 1, wherein the metal locking member has a terminal portion for connection to a second board that is fixed to the housing.

6. The board connector according to claim 1, wherein the contact has a connecting portion that connects between the first beam portion and the second beam portion.

7. The board connector according to claim 1, wherein a plurality of contacts are provided and are arranged in parallel with each other in a direction perpendicular to the board insertion direction.

8. The board connector according to claim 1, wherein the metal locking member has a first beam portion that is fixed to the actuator, a second beam portion that is fixed to the housing, a connecting portion that connects between the first beam portion and the second beam portion, and a ground contact portion adapted to be brought into contact with a mating ground contact portion of the board, the first beam portion, the second beam portion, the connecting portion, and the ground contact portion being integral with each other.

9. The board connector according to claim 1, wherein the metal locking member has a locking portion for holding a fitted state of the board.

10. The board connector according to claim 9, wherein an angle between the locking portion and a board insertion direction for the board is set so that, by pulling out the board toward a rear side in the board insertion direction in a state where the fitted state of the board is held by the locking portion, the actuator and the metal locking member are moved in a direction away from the housing to allow removal of the board.

* * * * *